US008061275B1

(12) United States Patent
Gold

(10) Patent No.: US 8,061,275 B1
(45) Date of Patent: Nov. 22, 2011

(54) WARHEAD SELECTIVELY RELEASING FRAGMENTS OF VARIED SIZES AND SHAPES

(75) Inventor: Vladimir M. Gold, Hillside, NJ (US)

(73) Assignee: The United States of America as represented by the Secretary of the Army, Washingon, DC (US)

( * ) Notice: Subject to any disclaimer, the term of this patent is extended or adjusted under 35 U.S.C. 154(b) by 24 days.

(21) Appl. No.: 12/684,224

(22) Filed: Jan. 8, 2010

(51) Int. Cl.
*F42B 12/22* (2006.01)

(52) U.S. Cl. ..... 102/495; 102/493

(58) Field of Classification Search ..... 102/491, 102/492, 493, 494, 495, 496, 497
See application file for complete search history.

(56) References Cited

U.S. PATENT DOCUMENTS

| | | | | | |
|---|---|---|---|---|---|
| 3,491,694 | A * | 1/1970 | Fountain | 102/493 |
| 4,106,411 | A * | 8/1978 | Borcher et al. | 102/495 |
| 4,312,274 | A * | 1/1982 | Zernow | 102/493 |
| 4,648,323 | A * | 3/1987 | Lawther | 102/495 |
| 4,745,864 | A * | 5/1988 | Craddock | 102/491 |
| 4,823,701 | A * | 4/1989 | Wilhelm | 102/492 |
| 4,899,661 | A * | 2/1990 | Kaelin | 102/495 |
| 4,974,516 | A * | 12/1990 | Eyal et al. | 102/476 |
| H1047 | H * | 5/1992 | Henderson et al. | 102/496 |
| H1048 | H * | 5/1992 | Wilson et al. | 102/496 |
| 5,117,759 | A * | 6/1992 | Henderson et al. | 102/496 |
| 5,131,329 | A * | 7/1992 | Lips et al. | 102/364 |
| 5,313,890 | A * | 5/1994 | Cuadros | 102/496 |
| 5,337,673 | A * | 8/1994 | Koontz et al. | 102/491 |
| 5,544,589 | A * | 8/1996 | Held | 102/492 |
| 5,979,332 | A * | 11/1999 | Hammer et al. | 102/496 |
| 6,619,210 | B1 * | 9/2003 | Spivak et al. | 102/476 |
| 7,007,608 | B2 * | 3/2006 | Flanagan | 102/494 |
| 7,143,698 | B2 * | 12/2006 | Lloyd | 102/489 |
| 7,614,348 | B2 * | 11/2009 | Truitt et al. | 102/491 |
| 2005/0087088 | A1 * | 4/2005 | Lacy et al. | 102/495 |

* cited by examiner

*Primary Examiner* — James Bergin
(74) *Attorney, Agent, or Firm* — Michael C. Sachs

(57) ABSTRACT

A fragmentation warhead includes a cylindrical body, and an explosive charge disposed within the innermost part of the warhead body. Upon detonation of the explosive charge, the warhead body is ultimately caused to shear and break into fragments with controlled sizes, shapes. This invention enables target-adaptable fragmentation output based selectively controlling the size of preformed fragments ejected. Preformed tungsten alloy fragments of a first "small" size "A" are sintered to be joined into a plurality of larger size fragments "B", using a tungsten alloy matrix. The B fragments are then joined into a desired shell shape and thickness and sintered into a fragmenting shell body using a different tungsten alloy matrix with bonds of melting point considerably lower than amongst the A fragment bonds.

10 Claims, 4 Drawing Sheets

WARHEAD SELECTIVELY RELEASING FRAGMENTS OF VARIED SIZES AND SHAPES

U.S. GOVERNMENT INTEREST

The inventions described herein may be made, used, or licensed by or for the U.S. Government for U.S. Government purposes.

BACKGROUND OF INVENTION

Warhead fragmentation effectiveness is determined by the number, mass, shape, and velocity of the warhead's fragments. By using a controlled fragmentation design, warhead fragmentation can generally be achieved quickly and in a cost effective manner. Exemplary controlled fragmentation techniques are described in U.S. Pat. Nos. 3,491,694; 4,312,274; 4,745,864; 5,131,329; and 5,337,673.

Conventional designs in general use include "cutter" liners that form fragments by generating a complex pattern of high-velocity "penetrators" for fragmenting the shell. Although these conventional fragmentation designs have proven to be useful, it would be desirable to present additional function, cost and safety improvements that minimize the warhead weight, reduce manufacture expenses, and/or advance current United States green and insensitive munition requirements.

Desirable therefore, is a convenient, less expensive, shell fragmentation technique to selectively generate multiple sizes of fragments. It would also be desirable to be able to selectively generate variations in fragment numbers, shapes, and fragment patterns of exploding warheads.

SUMMARY OF INVENTION

The present invention satisfies these needs, and presents a munition or warhead such as part of a projectile made with novel metallurgical configurations which can be used for generating diverse fragmentation patterns. Larger size fragments are selected for more heavily armored targets, while smaller size fragments can be used for lightly armored or soft targets. This invention enables target-adaptable fragmentation output based on means for selectively controlling the size of preformed fragments ejected. According to an embodiment of the invention, preformed tungsten alloy fragments of a first "small" size "A" are sintered to be joined into a plurality of larger size fragments "B", using a tungsten alloy matrix Am. The B fragments are then sized to a desired shell shape and thickness and sintered into a fragmenting shell body using a tungsten alloy matrix Bm. The nature of the bonds between either A fragments or B fragments are such that the bonds are capable of being melted under intense heat. However, the melting point of the bonds between B fragments are made to be considerably lower than the melting point amongst the A fragments. The bonds between B fragments are made with eutectic tungsten alloy to create a lower melting point than bonds between A fragments. According to an embodiment of this invention, controlling the size of fragments ejected can be accomplished by selectively changing the matrix bonds Am and Bm through heating the fragmenting shell prior to detonation of the main explosive charge. This is because at the lower melting point for B bonds, matrix bonds Am between fragments A may still remain intact. Though heated, the temperature would be still less than the melting point for A bonds. Therefore such preheating favors formation of large-size fragments B during detonation.

According to an embodiment of this invention, in large-size-fragment-mode, heat flux is directed towards melting of matrix Bm by first detonating a propellant 304 termed a "dual-purpose" propellant, which is adjacent a steel pusher shell 301 which is in turn adjacent the fragmentation shell body 200. The dual-purpose propellant is located between a thermal insulation shell means 307 and the steel pusher shell 301. Thermal insulation shell means 307 might be made from a Kevlar filled EPDM rubber. Beyond the thermal insulation shell means 307 lies another (not yet detonated) charge 310, being called the "main explosive charge". Deflagration of the dual-purpose propellant generates strong heat flux into the fragmenting shell (even through the steel pusher shell 301) capable of melting matrix bonds B. A split second later (after enough time is allowed to permit matrix bonds Bm to melt, perhaps milliseconds), the main charge explosive is then initiated by a mechanism (not shown) that permits this predetermined time delay between initiating the dual-purpose propellant and then initiating the main explosive charge. Such later initiation of the main explosive charge would then result in large-size fragments B being generated as the (warmed up) fragmentation shell body ruptures. For the small-size fragment mode, the main explosive charge is initiated first, which in turn shock initiates the dual-purpose propellant to detonate. As a result of such detonation of the dual-purpose propellant adjacent the fragmentation shell, small-size fragments A are directly generated as the fragmentation shell body directly ruptures. It will be seen this scenario doesn't leave enough time for B bonds to first melt as in the large fragment generation scenario. The fragmentation shell body would just rupture into A size fragments. The purpose of steel pusher shell 301 is to at least temporarily provide a more solid base from against which fragments and detonation products may be bounced/propelled outward at their high pressure and high temperature, as the fragmenting shell body breaks. Eventually, even the pusher 301 will disintegrate. The various shapes, sizes, numerical ratio, and placement locations of the A and B type fragments in the fragmenting shell body may be varied to suit operational needs and packing ratios, e.g. for instance, fragments A may be chosen to simply be particles (similar to dust) which have been sintered together. In the small size fragment mode, a dust like explosion of the fragmenting shell would result from such A type fragments.

This invention is distinguishable from existing fragmentation liner technologies that attempt to score or cut the warhead body, instead, during explosion of the warhead, detonation shock waves propagated at the enclosed fragment locations generate contours of localized transitional regions with high-gradients of pressures, velocities, strains, and strain-rates acting as stress and strain concentration factors. As a result, the explosion produces a complex pattern of shear planes in the warhead body, causing shell break-up and release of fragments with predetermined sizes. One of the advantages of the present embodiment compared to existing technologies is the cost effectiveness of the manufacturing process of the present design, in that it is faster and more economical to fabricate, as opposed to notching or cutting a steel warhead body itself. In another variation of the invention (FIG. 4), dual purpose propellant (404) is on the outside of fragmenting shell 200, rather than on the inside of fragmenting shell 200 as was 304 in the FIG. 3 version. Thermal shield 307 as used in the FIG. 3 version to divide between the dual purpose propellant and the main charge (310) is therefore not needed in the FIG. 4 version. On the exterior of dual purpose propellant 404, there is a lightweight composite covering 405. Prior detonation of the dual purpose propellant 404 on the outside of fragmenting shell 200 in FIG. 4 accomplishes the same purpose as in FIG.

3, i.e., it melts the Bm bonds between large B size fragments; then the main charge 310 is detonated. It is also conceivable to destroy the Bm bonds between large B size fragments by first detonating exploding ink painted on the Bm bonds on the outside of fragmenting shell 200, rather than detonation of the dual purpose propellant 404 there (such exploding ink is not painted over the Am bonds, in such version); then the main charge 310 is detonated. This invention has application to the 105 mm STAR ATO round and also to multifunctional airburst, hardened penetrator, anti-personnel, anti-materiel, insensitive munitions, and insensitive blast warheads. This product is considered to be more green because tungsten is largely used to replace other metals such as lead which may be considered more toxic. The more green tungsten material is consistent with current green goals and government requirements for minimizing toxicity.

OBJECTS OF THE INVENTION

It is therefore an object of the present invention to provide means for generating fragments upon detonation of a warhead, with a relatively less expensive to manufacture structure of tungsten alloy fragments, and;

It is a further object of the present invention to provide a fragmentation warhead which generates fragments upon detonation wherein the size and shape of such fragments may be selected through selective detonation of the warhead material, and;

It is a yet another object of the present invention to provide a fragmentation warhead of materials additionally chosen for green value, i.e., less toxicity.

These and other objects, features and advantages of the invention will become more apparent in view of the within detailed descriptions of the invention and in light of the following drawings, in which:

DETAILED DESCRIPTION

Figure 1:
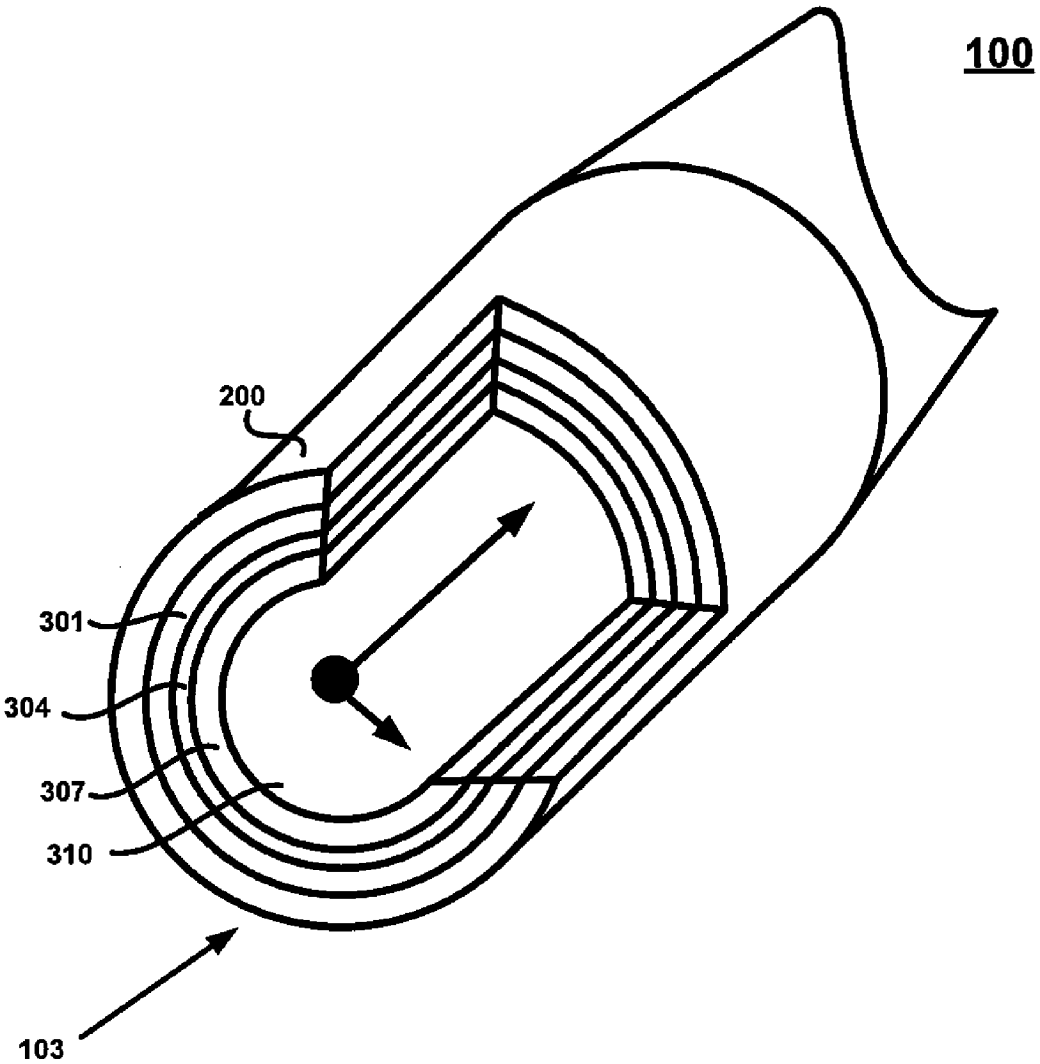
FIG. 1 shows a cutaway isometric view of a fragmenting warhead assembly according to this invention.

FIG. 1 illustrates an exemplary warhead, projectile, shell, munition, explosively formed projectile, or shaped charge liner, etc., (referenced herein as warhead 100), utilizing controlled fragmentation of a warhead body 200 according to the present invention. The warhead generally takes a cylindrical shape. FIG. 1 depicts, through open end 103, a round 100 generally comprising fragmenting warhead body 200, steel pusher shell 301, a dual purpose explosive 304, a thermal insulation 307, a main explosive charge 310, which have back plates (not shown), and an initiation mechanism assembly (not shown). It should be appreciated that the respective sizes of the warhead housing, thicknesses, lengths, and/or diameters are not precisely to scale in these drawings. The main explosive charge 310 comprises, for example, LX-14, OCTOL, hand packed C-4, or any other solid explosive, that can be machined, cast, or hand-packed to fit snugly within the inside of thermal insulation 307. On the other hand, propellant 304 can be a conventional propellant such as JA-2 (a less powerful explosive than 310). A newer dual propellant explosive such as RASP-3 MTOP now exists which might in the future be actually used for both 304 and for 310 if properly adapted with the required initiation mechanisms and with suitable timing.

Figure 2:
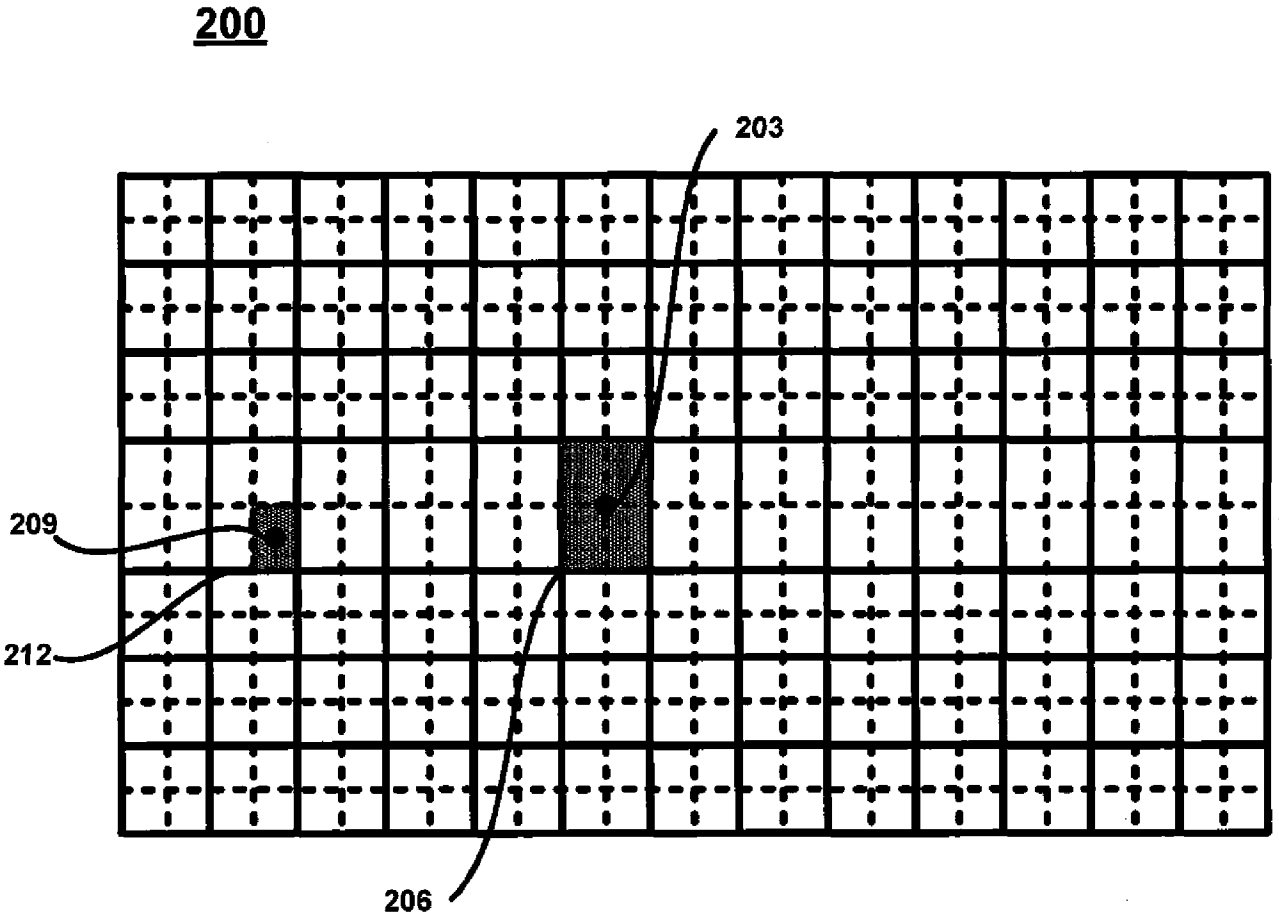
FIG. 2 shows arrangement of fragments in the fragmenting warhead of FIG. 1.

The body 200 encloses a multiplicity of tungsten alloy fragments (see FIGS. 2, 3) of select sizes and shapes, and green is used in the sense of using less toxic tungsten as material rather than for instance a more toxic lead material. A selectively controlled pattern of fragments can comprise sections of equal size or, alternatively, sections ranging in size from relatively large to smaller fragments. The larger size of the fragments is selected for more heavily armored targets, while the smaller size of fragments is applicable for lightly armored or soft targets. Consequently, the pattern efficiently enables variable target lethality of the warhead 200 that can range from maximum lethality for more heavily armored targets to a maximum lethality for lightly armored or soft targets. Shapes of individual fragments can be widely varied (dust particles, spheres, ellipsoids, cylinders, pyramids, cubes, parallelepipeds, curved external shapes, shards, diamond shaped, or truncated versions of any of the above, for instance). Size of individual fragments and orientation of the fragments (turned such as 90 degrees from one another, e.g.) can all be individually selected to advantage in designing the ultimate warhead fragments. According to an embodiment of the invention illustrated by FIGS. 2 and 3, this invention enables target-adaptable fragmentation output based on means for selectively controlling the size of preformed fragments ejected. According to an embodiment of the invention, preformed tungsten alloy fragments of a first "small" size "A" (209) are sintered to be joined into a plurality of larger size fragments "B" (203), using a tungsten alloy matrix Am (212). The B fragments are then sized to a desired shell shape and thickness and sintered into a fragmenting shell body using a tungsten alloy matrix Bm (206). The nature of the bonds between either A fragments or B fragments are such that the bonds are capable of being melted under intense heat. However, the melting point of the bonds between B fragments are made to be considerably lower than the melting point amongst the A fragments. The bonds between B fragments are made with eutectic tungsten alloy to create a lower melting point than bonds between A fragments. According to an embodiment of this invention, controlling the size of fragments ejected can be accomplished by selectively changing the matrix bonds Am and Bm through heating the fragmenting shell prior to detonation of the main explosive charge. This is because at the lower melting point for B bonds, matrix bonds Am between fragments A may still remain intact. Though heated, the temperature would be still less than the melting point for A bonds. Therefore such preheating favors formation of large-size fragments B during detonation. According to an embodiment of this invention, in large-size-fragment-mode, heat flux is directed towards melting of matrix Bm by first detonating a propellant 304 termed a "dual-purpose" propellant, which is adjacent a steel pusher shell 301 which is in turn adjacent the fragmentation shell body 200. The dual-purpose propellant is located between a thermal insulation shell means 307 and the steel pusher shell 301. Thermal insulation shell means 307 might be made from a Kevlar filled EPDM rubber. Beyond the thermal insulation shell means 307 lies another (not yet detonated) charge 310, being called the "main explosive charge". Deflagration of the dual-purpose propellant 304 generates strong heat flux into the fragmenting shell 200 (even through the steel pusher shell 301) capable of melting matrix bonds Bm. A split second later (after enough time is allowed to permit matrix bonds Bm to melt, perhaps milliseconds), the main charge explosive 310 is then initiated by a mechanism (not shown) that permits this predetermined time delay between initiating the dual-purpose propellant 304 and then initiating the main explosive charge 310. Such later initiation of the main explosive charge would then result in large-size fragments B being generated as the (warmed up) fragmentation shell body 200 ruptures. For the small-size fragment mode, the main explosive charge 310 is initiated first, which in turn shock initiates the dual-purpose propellant 304 to detonate. As a result of such detonation of the dual-purpose propellant 304 adjacent the fragmentation shell 200, small-size fragments A (209) are directly generated as the fragmentation shell body 200 directly ruptures. It will be seen this scenario doesn't leave enough time for Bm bonds to first melt as was the case in the large fragment generation scenario. The fragmentation shell body would just rupture into small A size fragments. The purpose of steel pusher shell 301 is to at least temporarily provide a more solid base from against which fragments and detonation products may be bounced/propelled outward at their high pressure and high temperature, as the fragmenting shell body 200 breaks. Eventually, even the pusher shell 301 will disintegrate. The various shapes, sizes, numerical ratio, and placement locations of the A and B type fragments in the fragmenting shell body may be varied to suit operational needs and packing ratios, e.g. for instance, fragments A may be chosen to simply be particles (similar to dust) which have been sintered together. In the small size fragment mode, a dust like explosion of the fragmenting shell would result from such A type fragments.

Figure 3:
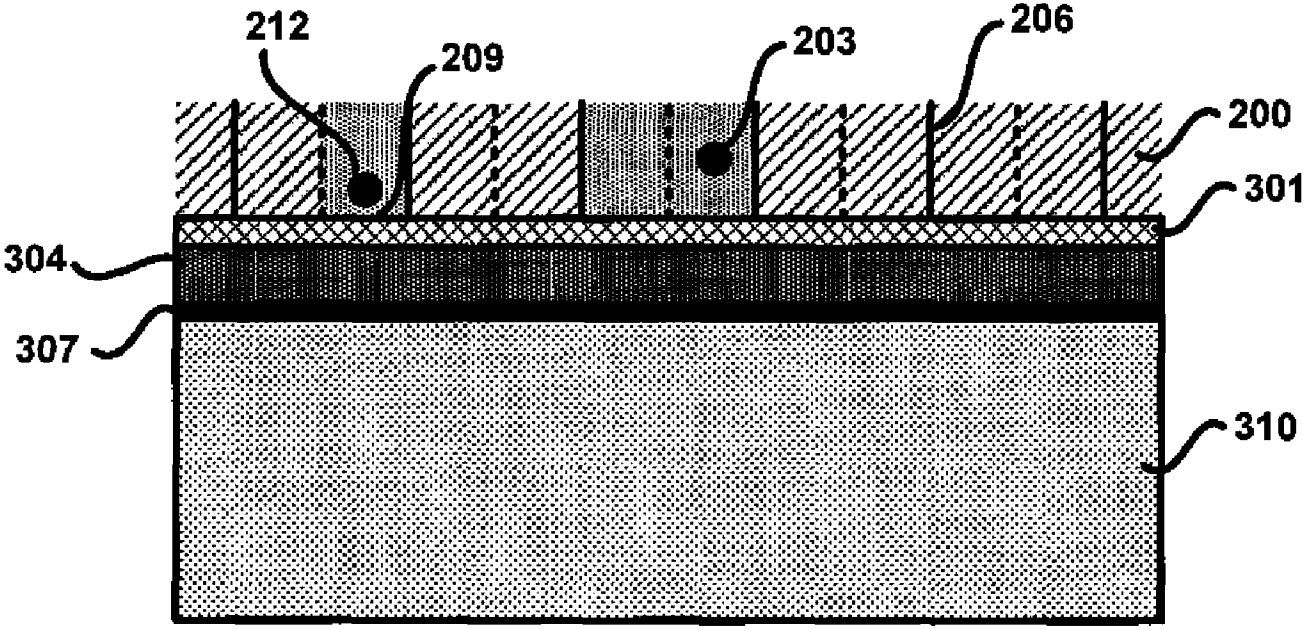
FIG. 3 shows a partial cross section of the ammunition round of FIG. 1 which includes a propellant, main explosive charge, a pusher plate, a fragmenting warhead, and a thermal shield.
Figure 4:
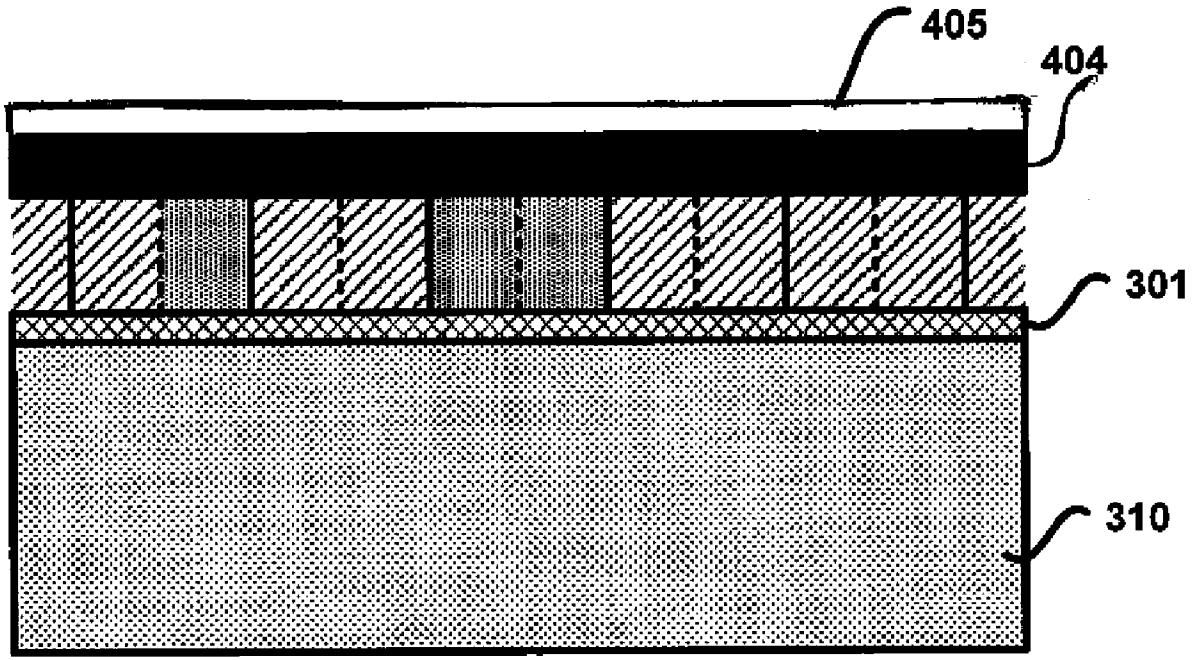
FIG. 4 shows a partial cross section of a different variation of the ammunition round of FIG. 1 which includes a propellant on the exterior of the fragmenting warhead.

In another variation of the invention (FIG. 4), dual purpose propellant (404) is on the outside of fragmenting shell 200, rather than on the inside of fragmenting shell 200 as was 304 in the FIG. 3 version. Thermal shield 307 as used in the FIG. 3 version to divide between the dual purpose propellant and the main charge (310) is therefore not needed in the FIG. 4 version. On the exterior of dual purpose propellant 404, there is a lightweight composite covering 405. Prior detonation of the dual purpose propellant 404 on the outside of fragmenting shell 200 in FIG. 4 accomplishes the same purpose as in FIG. 3, i.e., it melts the Bm bonds between large B size fragments; then the main charge 310 is detonated. It is also conceivable to destroy the Bm bonds between large B size fragments by first detonating exploding ink painted on the Bm bonds on the outside of fragmenting shell 200, rather than detonation of the dual purpose propellant 404 there (such exploding ink is not painted over the Am bonds, in such version); then the main charge 310 is detonated.

This invention has application to the 105 mm STAR ATO round and also to multifunctional airburst, hardened penetrator, anti-personnel, anti-materiel, insensitive munitions, and insensitive blast warheads.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A fragmenting warhead wherein fragment sizes can be preselected, comprising a cylindrical body with preselected fragmentation patterns, wherein the cylindrical body comprises a within cylindrical steel pusher shell, said pusher shell further comprising a cylindrical main explosive charge; and wherein the cylindrical body comprises tungsten alloy fragments of preselected small and large sizes wherein the small fragments are bonded together and sintered into large fragments and the large fragments are then arranged in preselected patterns which are bonded, pressed then sintered into the desired cylindrical body shape; and wherein the bonds between large sized fragments can melt at a lower temperature than the bonds between small sized fragments; and, wherein the immediate interior of the cylindrical body is lined with propellant and wherein there is a thermal insulation device in between the propellant and the said steel pusher shell to prevent detonation of the propellant from in turn setting off the main explosive charge, and wherein ignition of the propellant essentially will cause a heating of the cylindrical body, which causes melting of bonds between the large fragments initially, which then is followed by a closely timed eventual detonation of the main explosive charge to cause detonation energy to propagate directly to the interior of the cylindrical body causing the cylindrical body to shear and break essentially only into fragments with controlled large fragment sizes and large size fragmentation patterns.

2. The warhead of claim 1, wherein the fragments are ellipsoid in shape.

3. The warhead of claim 1, wherein the fragments are cubic in shape.

4. The warhead of claim 1, wherein the fragments are made from shards.

5. The warhead of claim 1, wherein the small fragments are made from dust size particles.

6. The warhead of claim 1, wherein the main explosive charge is made from OCTOL material.

7. The warhead of claim 1, wherein the main explosive charge is made from hand packed C-4 material.

8. The warhead of claim 1, wherein the propellant is JA-2.

9. The warhead of claim 1, wherein the propellant is RASP-3 MTOP.

10. The warhead of claim 1, wherein the warhead includes any one of an exploding body warhead, an explosively formed projectile, and a shaped charge liner.

* * * * *